US005388294A

United States Patent [19]

Reeder

[11] Patent Number: 5,388,294

[45] Date of Patent: Feb. 14, 1995

[54] PIVOTING HANDLES FOR HOSPITAL BED

[75] Inventor: Ryan A. Reeder, Brookville, Ind.

[73] Assignee: Hill-Rom Company, Inc., Batesville, Ind.

[21] Appl. No.: 75,992

[22] Filed: Jun. 11, 1993

[51] Int. Cl.[6] ..... A61G 7/08

[52] U.S. Cl. ..... 5/600; 5/662; 280/47.371

[58] Field of Search ..... 5/600, 658, 662, 510, 5/602; 280/47.371, 655.1, 655

[56] References Cited

U.S. PATENT DOCUMENTS 1,778,698 10/1930 Walter ..... 5/662
5,060,327 10/1991 Celestina et al. ..... 5/662
5,069,465 12/1991 Stryker et al. ..... 403/102
5,094,418 3/1992 McBarnes, Jr. et al. ..... 5/658
5,255,403 10/1993 Ortiz ..... 5/658

*Primary Examiner*—Alexander Grosz
*Attorney, Agent, or Firm*—Wood, Herron & Evans

[57] ABSTRACT

A hospital bed with pivoting handles to be used for conveniently maneuvering the hospital bed. The handles are pivotally mounted to the bed frame at the head end of the hospital bed and can be pivoted between a generally horizontal stored position and a generally vertical operable position. Each bed handle is locked into the respective positions by a spring loaded pawl which is pivotally mounted to the bed frame. As the bed handles pivot between the operable and stored positions, the pawl rotates from a locked position to an unlocked position and then returns to the locked position as a result of the force applied by the torsion spring.

10 Claims, 3 Drawing Sheets

PIVOTING HANDLES FOR HOSPITAL BED

FIELD OF THE INVENTION

This invention relates to hospital beds, and more particularly, to a mobile hospital bed having improved handles which are pivoted between a stored position and an operable position for convenient maneuvering of the bed.

BACKGROUND OF THE INVENTION

A hospital bed has a base with castors on it so that it can be moved about and is often used in hospitals to move patients from place to place requiring hospital personnel to manually maneuver the hospital bed. A single care provider should be able to manually maneuver the hospital bed, and preferably the bed should be maneuverable from the head end or the foot end in order to facilitate easy transportation within the relatively narrow hallways of some hospitals. It is common for a care provider to be at the head end of a hospital bed; however, this also raises a problem with respect to the positioning of a handle at the head end of a hospital bed. The problem is that when the hospital bed is stationary, a nurse or care provider administering to the patient needs full access to the patient without the obstruction of a handle or other mechanism.

Hospital beds typically have collapsible patient side guards which can be provided on the lateral sides of the hospital bed toward the foot end or head end of the patient as disclosed in U.S. Pat. Nos. 5,077,843; 5,054,141; and 4,985,946 each assigned to the assignee of the present invention. A care provider at the end of the bed can lean forward and hold onto the patient side guards using them to maneuver the bed. However, maneuvering the hospital bed from the end of the bed while grasping the side guards requires leaning over the patient in a manner which is cumbersome and uncomfortable for both the care provider and the patient situated on the bed.

To avoid leaning over the patient to maneuver the hospital bed, it is common to grasp a bed frame which is connected to the hospital bed base and supports a mattress. However, a firm grasp on the bed frame at the head end or lateral side of the hospital bed is often difficult to achieve because a suitable bar or grip is often, at the least, not accessible, or worse yet, absent. Another approach to maneuver a hospital bed is to grasp a piece of auxiliary equipment for support which is provided on the bed for diagnostic procedures and examinations such as a monitor or intravenous mechanism. However, such auxiliary supporting apparatus is typically inadequate to withstand the forces required to maneuver and control a full size hospital bed with a patient situated thereon.

A prior solution to these problems is disclosed in U.S. Pat. No. 5,069,465 which has push handles for maneuvering a hospital stretcher. The stretcher has at one end two L-shaped handles which are each supported at an outer end of one of the two legs of the handle by an extension. The extension on each handle is pinned to the stretcher and when the handles are lifted into position for maneuvering the stretcher a sleeve slides to cover the extension at the point it is pin mounted to the stretcher. Once the sleeve slides to cover the extension the handle is secured for maneuvering the stretcher.

This sliding sleeve mechanism as described in U.S. Pat. No. 5,069,465 is subject to criticism, however. The mechanism by its nature creates undesirable play or "slop" thus yielding an insecure feel when maneuvering the bed. In addition, the sliding mechanism is difficult to properly clean and disinfect, causing the rather substantial sliding surfaces of the mechanism to be a potential source of contamination and infection. Finally, the sliding mechanism is subject to failure due to the wear upon the mating sliding surfaces.

SUMMARY OF THE INVENTION

An objective of the present invention is to provide an improved bed handle for the manual maneuvering of a hospital bed which can be stored when not in use so as not to obstruct access to a patient by a care provider or nurse.

An additional objective of the invention is to provide a handle for a mobile hospital bed which is both easy and inexpensive to manufacture and simple and durable to operate that does not wear or generate undesirable play in use.

A further objective of the present invention is to provide a handle which is readily disinfected through ease of cleansing.

A hospital bed, provided with such handles, makes possible the convenient and easy maneuvering of the patient about the hospital. Such a hospital bed with handles eliminates the difficulty of grasping patient side guards, the end of the bed with the bed frame, or the auxiliary medical equipment associated with the hospital bed for transportation about the hospital.

The objectives of the present invention are achieved by providing a hospital bed with a pair of pivoting posts mounted at the head end of the bed. The posts function as bed handles and can be manually pivoted between a generally horizontal stored position within a plane generally defined by the patient support surface of the hospital bed and a generally vertical operable position. The handles are locked in these respective positions by a pawl and cooperating torsion spring. As the bed handle is pivoted from the stored generally horizontal position to the operable generally vertical position, it frictionally engages the spring biased pawl mounted on the bed frame. During the pivoting of the bed handle to the operable position, sliding contact between the bed handle and the pawl pivots the pawl toward an unlocked position, thereby compressing the torsion spring.

Once the post reaches the operable position, the sliding contact ceases between the bed handle and the pawl edge surface and the pawl pivots into a locked position as a result of the expansion of the torsion spring and locks the bed handle in the generally vertical position.

After use, the bed handle is returned to the stored position by manually depressing a pad provided on the pawl. When the pad is manually depressed the torsion spring compresses and the pawl is pivoted from the locked position to the unlocked position, thereby permitting the bed handle to be manually pivoted to the generally horizontal stored position. Once the bed handle is returned to the stored position, the pad on the pawl is released, thereby permitting the torsion spring to expand and return the pawl to the locked position securing the handle.

The present invention further provides a stop which is fixedly mounted to the bed frame which prevents the bed handle from pivoting beyond a generally vertical orientation when swiveled to the operable position.

A further feature of the present invention is the provision of a grip fixedly mounted to the bed frame in a generally horizontal position which forms an L-shaped configuration with the post when in the operable position. The grip can be used to manipulate the hospital bed at any time regardless of the position of the pivoting bed handle.

BRIEF DESCRIPTION OF THE DRAWINGS

The several features and objectives of the invention will become more readily apparent from the following detailed description taken in conjunction with the accompanying drawings in which.

DETAILED DESCRIPTION OF THE INVENTION

Figure 1:
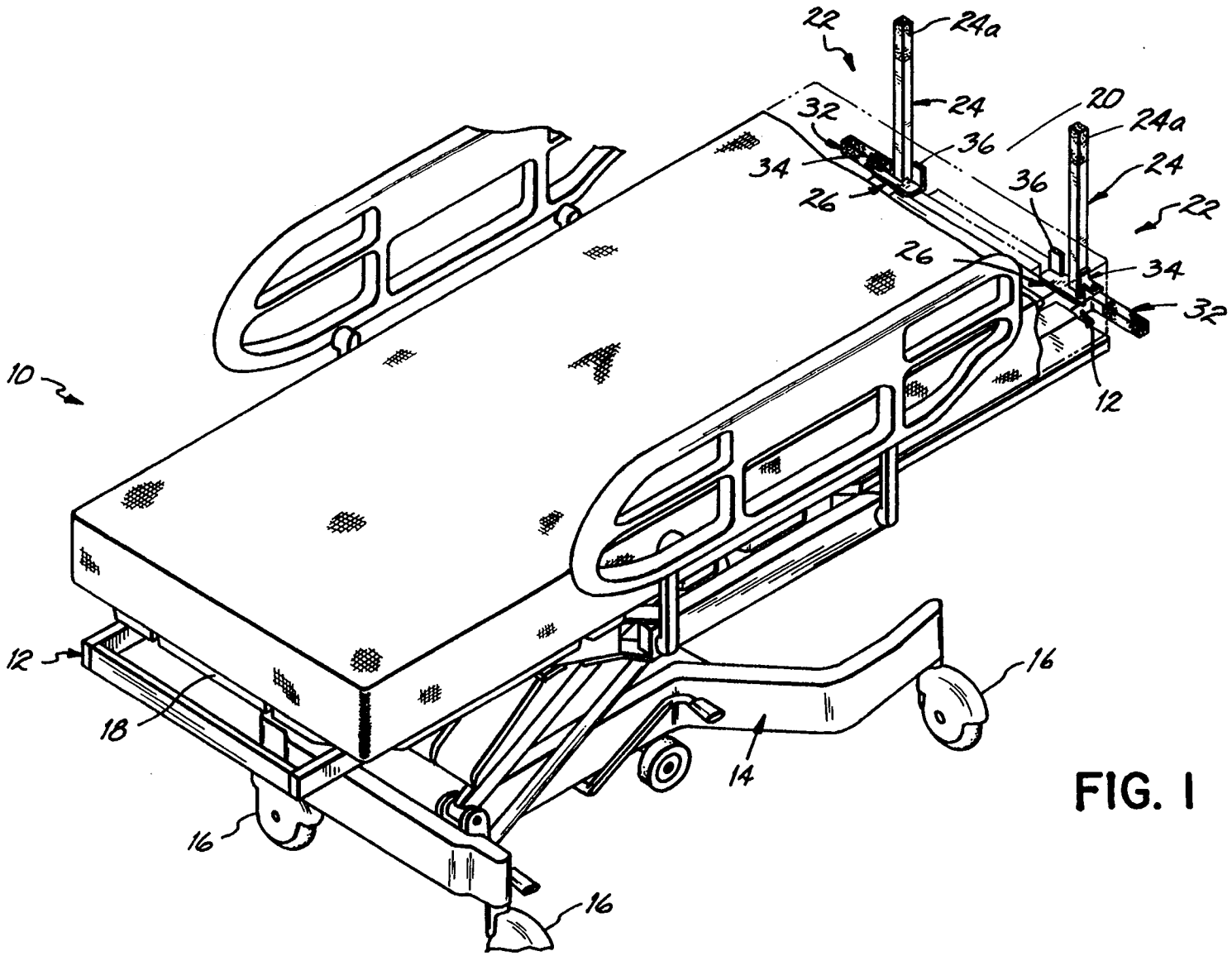
FIG. 1 is a perspective view of a hospital bed with the pivoting bed handles of the present invention.

Referring to FIG. 1, a hospital bed 10 with a bed frame 12 mounted on a base 14 with castors 16 is shown. The hospital bed 10 has a foot end 18 spaced from a head end 20 where a pair of pivoting bed handles 22, 22 according to the present invention are mounted on the bed frame 12. In the preferred embodiment of the present invention, the hospital bed 10 has the pair of pivoting bed handles 22, 22 mounted proximate each side of the bed at the head end 20.

Figure 2:
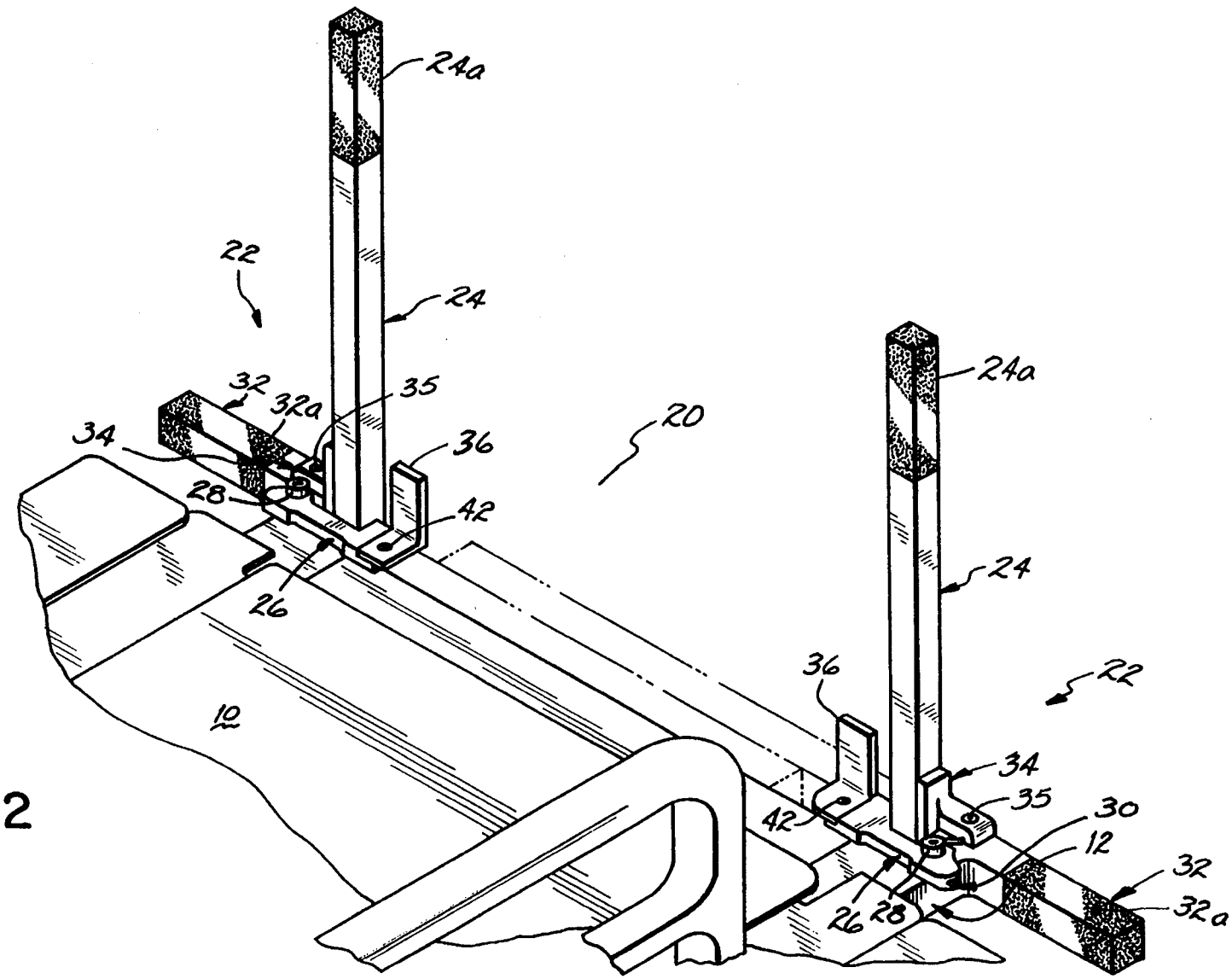
FIG. 2 is an enlarged perspective view of the bed handles of the present invention in the operable position and shown in phantom in the stored position at the head end of the hospital bed.

FIG. 2 shows an enlarged view of the pivoting bed handles 22 of the present invention. Each bed handle 22 comprises a post 24 pivotally mounted to the bed frame 12 as by a bolt 38 (FIG. 3), and a pawl 26 pivotally mounted to the bed frame 12 as by a bolt 28 and spring biased toward a locked position by a torsion spring 30. A stop 34 is fixedly mounted on the bed frame 12 adjacent the lower end of each post 24. The pawl 26 also includes a pad 36 which is used to manually operate the pawl 26 when positioning the post 24 to either an operable generally vertical position or a stored generally horizontal position. In addition, a fixed horizontal bed handle or grip 32 is fixedly mounted to the bed frame 12. Non-slip material can be applied to the ends of the posts 24 and grips 32 as shown at **24*a* and 32*a***, respectively, to provide for a secure hold for a care provider.

As shown in both FIG. 1 and FIG. 2, the bed handles 22 of the present invention are mounted in staggered fashion on the bed frame 12 so that when the posts 24 are in the stored generally horizontal position (as shown in phantom) they are side by side one another (one forward and one aft) generally in the plane of the bed frame 12 allowing unobstructed access to the patient situated on the hospital bed 10.

Figures 3, 4, 4A, 4B, 5:
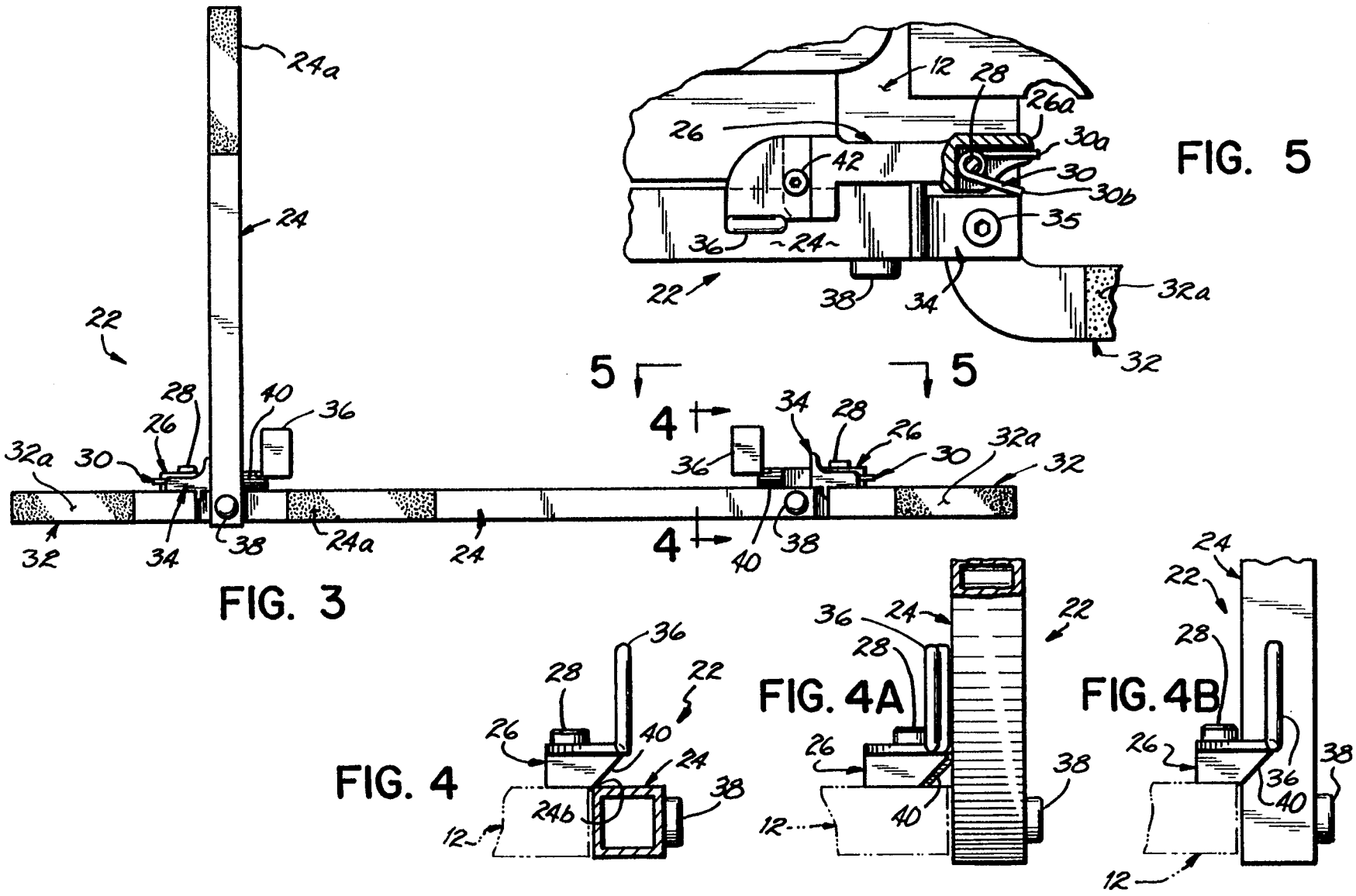
FIG. 3 is a head end elevational view of the bed with handles of the present invention showing one bed handle in the operable position and one bed handle in the stored position.
FIG. 4 is a cross-sectional view taken along line 4—4 of FIG. 3 showing the pawl of the present invention in the locked position and the bed handle in the stored position.
FIG. 4A is a view similar to FIG. 4 showing the pawl being rotated from the locked position to the unlocked position as the post is pivoted upwardly toward the operable position from the stored position.
FIG. 4B is a view similar to FIG. 4A showing the pawl of the present invention in the locked position and the bed handle in the operable position.
FIG. 5 is a cross-sectional view taken along line 5—5 of FIG. 3 showing the pawl in the locked position and the bed handle in the stored position.

FIG. 3 shows one post 24 in the operable position and one post 24 in the stored position. The posts 24 are pivoted about the bolt 38 or other suitable mechanism. The posts 24 are locked in either the operable position or the stored position by the pawl 26 pivotally mounted to the bed frame 12 in cooperation with the torsion spring 30 as can be most clearly seen in FIG. 5. The post 24 is secured in the stored position by a sloped edge surface 40 of the pawl 26, shown most clearly in FIG. 4, which obstructs upward movement of post 24 by contacting the top side corner **24*b* of same. To move the post 24 from the stored to the operable position, the post 24 would be manually pivoted upwardly, thereby slideably engaging the sloped edge surface 40 of the pawl 26. While the post 24 is being pivoted upward from the stored position, the pawl 26 rotates from a locked position as shown in FIG. 4 to an unlocked position shown in FIG. 4A as a result of the frictional contact between the post 24 and the sloped edge surface 40. As the pawl 26 rotates from the locked position to the unlocked position, the torsion spring 30 is compressed. Once the post 24 is pivoted to the operable position as shown in FIG. 4B and clears the sloped edge surface 40 of the pawl 26, the pawl 26 is returned to the locked position by the force applied to the pawl 26 from the expanding torsion spring 30. The post 24 is inhibited from pivoting beyond the operable generally vertical position by the stop 34 secured to bed frame 12 by a countersunk hexhead bolt 35. Once in the operable position, the post 24 is secured between the stop 34 and the pawl 26 in the locked position. As is best seen in FIG. 5, torsion spring 30 is operable between bed frame 12 and pawl 26, the torsion spring 30 having ends 30*a* and 30*b* which contact leg 26*a* of pawl 26 and stop 34, respectively. After each of the posts 24 is pivoted to the operable position, the hospital bed 10 can be maneuvered with ease by grasping the handles 22 conveniently provided at the head end of the hospital bed. Each post 24 when in the operable position is generally orthogonal to its respective grip 32** which can also be used to maneuver the bed.

In order to re-position the posts 24 from the operable position to the stored position and provide unobstructed access to the patient on the hospital bed 10, an upwardly projecting pad or tab 36 which is secured to pawl 26 as by screw 42 is manually depressed by a care provider in a direction generally parallel to the longitudinal dimension of the bed. As the pad 36 is manually depressed, the pawl 26 rotates from the locked position to an unlocked position, thereby compressing the torsion spring 30. Once the pawl 26 is in the unlocked position, the post 24 can be pivoted downward to the horizontal stored position (FIGS. 4A and 4). After the post 24 is in the stored position, the pad 36 is released; the expanding torsion spring 30 returns the pawl 26 to the locked position. The post 24 is locked in the stored position by the pawl 26 and the sloped edge surface 40 as shown in FIG. 4 until such time as the hospital bed 10 is to be moved and the post 24 returned to the operable position as previously described.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A hospital bed comprising:

a base;

a bed frame mounted on said base, said frame having a head end spaced from a foot end;

at least one post pivotally mounted on said frame at one of said ends, said post being pivotal between a generally horizontal, stored position and a generally vertical, operable position; and means for selectively locking said post in the operable position, said locking means comprising a pawl pivotally mounted on said frame and a torsion spring pivotally biasing said pawl in a first direction, said pawl and said torsion spring cooperating to lock said post in the generally vertical operable position, said pawl when pivoted in a second direction freeing said post and allowing said post to be pivoted to the generally horizontal, stored position.

2. The hospital bed of claim 1 further comprising:

tab means on said pawl for aiding a care provider in pivoting said pawl in said second direction.

3. The hospital bed of claim 1 further comprising:

stop means mounted on said frame for preventing said post from pivoting beyond a generally vertical orientation when said post is pivoted upwardly to the operable position.

4. The hospital bed of claim 1 further comprising:

at least one grip fixedly mounted on said bed frame in a generally horizontal position proximate said post, said grip being generally orthogonal to said post when said post is in the operable position.

5. A handle adapted for use on a hospital bed comprising:

at least one post adapted to be pivotally mounted to the hospital bed, said post being pivotal between a generally horizontal, stored position and a generally vertical, operable position; and means for selectively locking said post in the operable position, said locking means comprising a pawl adapted to be pivotally mounted on the hospital bed and a torsion spring pivotally biasing said pawl in a first direction, said pawl and said torsion spring cooperating to lock said post in the generally vertical, operable position, said pawl when pivoted in a second direction freeing said post to be pivoted to the generally horizontal, stored position.

6. The handle of claim 5 further comprising:

tab means on said pawl for aiding a care provider in pivoting said pawl in said second direction.

7. The handle of claim 5 further comprising:

stop means adapted to be mounted on the hospital bed for preventing said post from pivoting beyond a generally vertical orientation when said post is pivoted upwardly to the operable position.

8. The handle of claim 5 further comprising:

at least one grip adapted to be fixedly mounted on the hospital bed in a generally horizontal position proximate said post, said grip being generally orthogonal to said post in the operable position.

9. A hospital bed comprising:

a base;

a bed frame mounted on said base, said frame having a head end spaced from a foot end;

at least one post pivotally mounted on said frame at one of said ends, said post being pivotal between a generally horizontal, stored position and a generally vertical, operable position; and a pawl pivotally mounted on said frame and a torsion spring pivotally biasing said pawl in a first direction, said pawl and said torsion spring cooperating to lock said post in the generally vertical operable position, said pawl when pivoted in a second direction freeing said post and allowing said post to be pivoted to the generally horizontal, stored position.

10. A handle adapted for use on a hospital bed comprising:

at least one post adapted to be pivotally mounted to the hospital bed, said post being pivotal between a generally horizontal, stored position and a generally vertical, operable position; and a pawl adapted to be pivotally mounted on the hospital bed and a torsion spring pivotally biasing said pawl in a first direction, said pawl and said torsion spring cooperating to lock said post in the generally vertical, operable position, said pawl when pivoted in a second direction freeing said post to be pivoted to the generally horizontal, stored position.

* * * * *